US006371735B1

(12) United States Patent
Goodwin et al.

(10) Patent No.: US 6,371,735 B1
(45) Date of Patent: Apr. 16, 2002

(54) VACUUM PUMPS

(75) Inventors: David John Goodwin; Paul Milner, both of West Sussex (GB)

(73) Assignee: The BOC Group plc, Windlesham (GB)

( * ) Notice: Subject to any disclaimer, the term of this patent is extended or adjusted under 35 U.S.C. 154(b) by 0 days.

(21) Appl. No.: 09/661,814

(22) Filed: Sep. 14, 2000

(30) Foreign Application Priority Data

Sep. 16, 1999 (GB) ..... 9921983

(51) Int. Cl.[7] ..... F04B 3/00; F04B 5/00; F04B 25/00

(52) U.S. Cl. ..... 417/250; 415/90

(58) Field of Search ..... 417/244, 250, 417/251, 423.8, 44.1; 415/90

(56) References Cited

U.S. PATENT DOCUMENTS 3,969,039 A * 7/1976 Shoulders ..... 417/244
5,052,887 A * 10/1991 Novikov et al. ..... 415/90
5,238,362 A * 8/1993 Casaro et al. ..... 415/90
5,611,660 A * 3/1997 Wong et al. ..... 415/90
5,688,106 A * 11/1997 Cerruti et al. ..... 415/90
5,733,104 A * 3/1998 Conrad et al. ..... 417/44.1
5,971,725 A * 10/1999 de Simon et al. ..... 417/423.8
6,071,085 A * 6/2000 Bernhardt ..... 417/251
6,109,864 A * 8/2000 Schofield et al. ..... 415/90
6,179,573 B1 * 1/2001 Hablanian ..... 417/244

FOREIGN PATENT DOCUMENTS

CN WO95/28571 * 10/1995 ..... F04D/1/36
DE 19821634 * 11/1999 ..... F04D/19/04

* cited by examiner

*Primary Examiner*—Teresa Walberg
*Assistant Examiner*—Leonid M Fastovsky

(57) ABSTRACT

A vacuum pump comprising a shaft rotatable by means of a motor, at least two spaced pump stages mounted on the shaft, a first pump inlet through which gas can pass for passage through all the pump stages for evacuating a first system and a second pump inlet through which gas can enter the pump at an inter-stage location for passage through only subsequent stages of the pump for evacuating a second system, said first and second systems each having a gas outlet flange for attachment to a first or a second pump inlet, in which the vacuum pump is mounted relative to the respective first and second systems such that the longitudinal axis of the shaft is inclined to each of the gas outlet flanges.

4 Claims, 1 Drawing Sheet

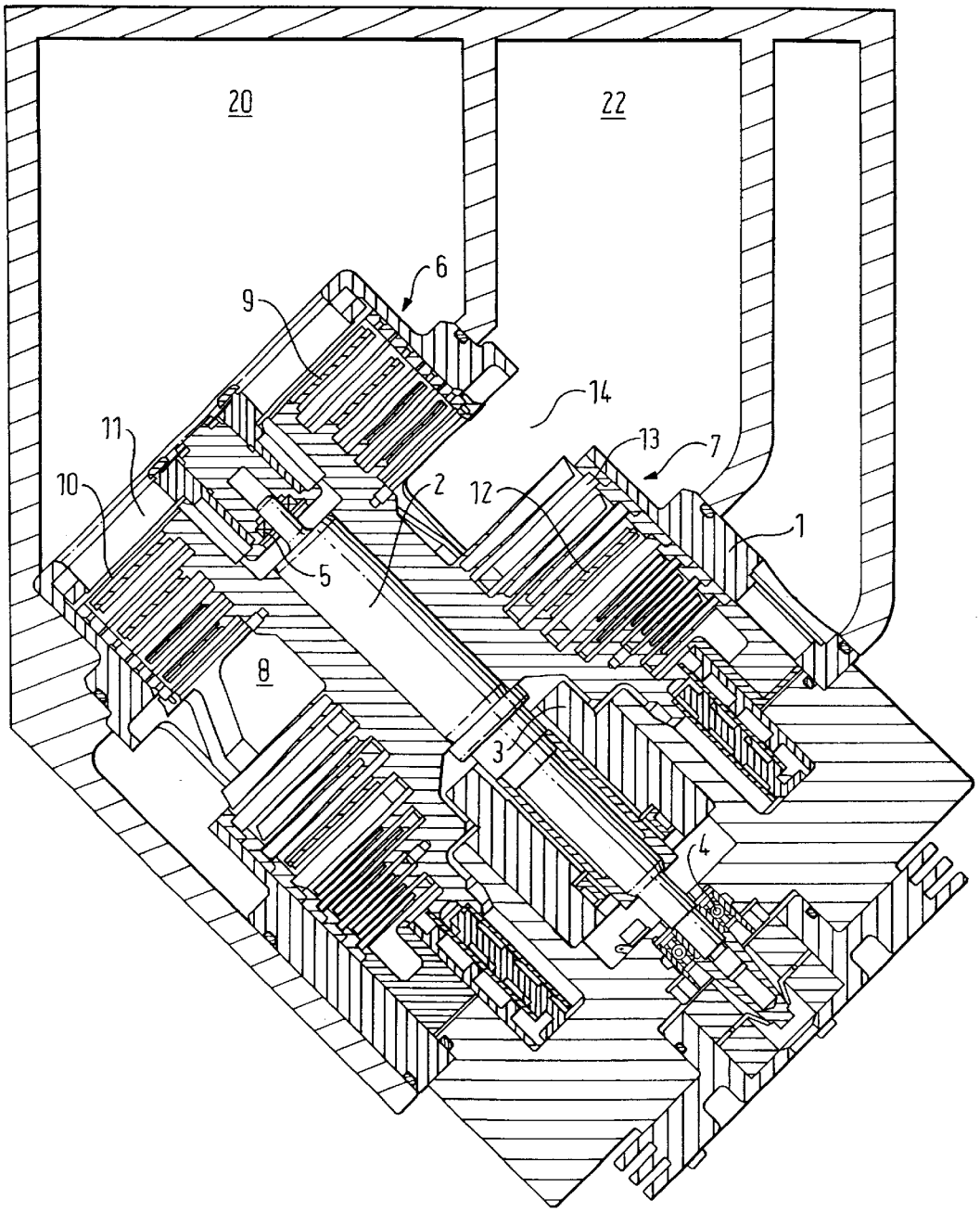
20
22
6
9
14
11
13
7
10
2
12
1
5
8
3
4

VACUUM PUMPS

FIELD OF THE INVENTION

The present invention relates to vacuum pumps and in particular to vacuum pumps employing a turbo-molecular mode of operation.

BACKGROUND OF THE INVENTION

A conventional turbo-molecular stage arrangement of a vacuum pump comprises a stack of alternate rotors and stators. Each stage effectively comprises a solid disc with a plurality of blades depending (nominally) radially therefrom; the blades are evenly spaced around the circumference of the disc and angled "about" radial lines out of the plane of the disc in the direction of rotation of the rotor stage.

The rotor and stator blades have positive and negative gradients respectively when viewed from the side in a radial line from the disc. This arrangement has the effect in molecular flow conditions of causing the movement of molecules through the pump.

There a number of types of apparatus where a plurality of chambers or systems need to be evacuated down to different levels of vacuum. For example, in well known types of mass spectrometer that part of the apparatus known as the detector commonly has to be operated at, say $10^{-6}$ mbar whereas that part known as the analyser has to be operated at a different level of vacuum, say $10^{-3}$.

In addition and importantly, the throughput of gas from the different parts of the apparatus will generally vary also. For example in a typical mass spectrometer of the type discussed above, there may need to be a 60 /second capacity for the detector and a 200 /second capacity for the analyser.

In apparatus of the type including but not restricted to mass spectrometers, a number of different vacuum pumps are normally employed. For example, in mass spectrometers, the detector and analyser may be evacuated by separate turbo-molecular vacuum pumps which themselves need to be backed by separate pumps, for example rotary vane pumps.

There is an ever increasing need to rationalise the use of the various vacuum pumps for overall reduced apparatus size and power requirements. A single backing pump is relatively common for supporting two (or more) turbo-molecular pumps. In addition, it has more recently been proposed to employ a single turbo-molecular pump to replace two (or more) individual pumps with the single pump having a normal inlet for gas required to pass through all the stages of the pump and an intermediate inlet, i.e. between the stages, for gas required to pass through only the latter stages of the pump.

In EP-A 0 919 726 there is described a vacuum comprising a plurality of vacuum stages and having a first pump inlet through which gas can pass through all the pump stages and a second inlet through which gas can enter the pump at an inter-stage location and pass only through a subsequent stage of the pump. The pump stages prior to the inter-stage location are sized differently from those stages subsequent to the inter-stage location which suits the pressure requirements/pumping capacity of different systems attached to the first and the second inlets respectively.

However, this known "split flow" pump suffers the disadvantage that when mounted to a mass spectrometer in a conventional manner for example with the axis of the pump or more particularly its shaft axis either parallel to or perpendicular to the plane of the outlet flanges of the mass spectrometer being evacuated gas flow problems have been observed. For example, when the vacuum pump is orientated with respect to the mass spectrometer such that the shaft axis is parallel to the plane of the outlet flanges of the mass spectrometer then gas must flow around a right angle bend to enter the pump inlet which results in a pressure drop and associated loss of pumping capacity.

When the vacuum pump is orientated with its shaft axis perpendicular to the plane of the inlet of the outlet flange gas may flow easily into the first inlet but the second inlet must be offset from the pump axis so that gas must flow around two bends in order to enter the second pump inlet.

It is an aim of the present invention to arrange the orientation of the vacuum pump relative to the systems to be evacuated such that the longitudinal axis of the vacuum pump shaft is inclined to each of the gas outlet flanges of the systems.

SUMMARY OF THE INVENTION

According to the present invention, a vacuum pump comprises a shaft rotatable by means of a motor, at least two spaced pump stages mounted on the shaft, a first pump inlet through which gas can pass for passage through all the pump stages for evacuating a first system and a second pump inlet through which gas can enter the pump at an inter-stage location for passage through only subsequent stages of the pump for evacuating the second system, such first and second systems each having a gas outlet flange for attachment to a first or a second pump inlet, in which a vacuum pump is mounted relative to the respective first and second systems such that the longitudinal axis of the shaft is inclined to each of the gas outlet flanges.

The shaft may be inclined at angle between 10 and 80 degrees inclusive but preferably at an angle of substantially 45 degrees.

In a preferred embodiment the pump stages are sized differently and are spaced one from another a distance equal to between 0.1 and 0.9 times the largest stage diameter.

DESCRIPTION OF THE DRAWINGS

An embodiment of the invention will now be described, by way of example reference being made to the FIGURE of the accompanying diagrammatic drawing which is a vertical section through a vacuum pump employing a turbo-molecular mode of operation.

DETAILED DESCRIPTION OF THE INVENTION

As shown, the vacuum pump has a multi-component body within which is mounted a shaft 2. Rotation of the shaft 2 is effected by means of a motor generally indicated at 3. The shaft 2 is supported at each end by lower (as shown) and upper (as shown) bearings 4 and 5.

Mounted on the shaft 2 are two sets of turbo-molecular stages generally indicated at 6 and 7 which are located before and after an inter-stage location 8.

The first set of turbo-molecular stages comprises four rotors (impellers) of angled blade construction as described above and of known construction, one of which is indicated at 9 and four corresponding stages again of angled blade construction and again, as described above, and of known construction one of which is indicated at 10.

An inlet 11 allows access of gas first to the set 6 of turbo-molecular stages and subsequently to set 7 of the turbo-molecular stages. The second turbo-molecular stage 7 comprises a further six rotors (impellers) of angled blade construction one of which is indicated at 12 and six corresponding stages again of angled blade construction one of which is indicated at 13. It will observed that the tip diameter of the turbo-molecular stages of set 6 is of smaller diameter than the tip diameter of the stages of the set 7.

A second inlet 14 allows gas to enter via the inter-stage location 8 and pass only through the second set 7 of turbo-molecular stages.

According to the present invention, the vacuum pump is so orientated with respect to the system(s) to be pumped for example the detector and analyser of a mass spectrometer that the longitudinal axis of the shaft 2 is inclined at an angle to the outlet from a first system 20 and also an outlet from a second system 22. By adopting this orientation gas is able to flow into the inlets 11, 14 of both stages by flowing around bends of obtuse angle so that there is little pressure drop and the effective pumping speed of both stages is relatively large. Further, since the shaft is at an inclined angle neither the length nor the height of the vacuum pump is excessively large.

In a preferred embodiment the pump stages 6 and 7 are spaced one from another a distance equal to between 0.1 and 0.9 times the largest stage diameter i.e. the diameter of the rotors of stage 7.

We claim:

1. A vacuum pump comprising a shaft rotatable by means of a motor, at least two spaced pump stages mounted on the shaft, a first pump inlet through which gas can pass for passage through all the pump stages for evacuating a first system and a second pump inlet through which gas can enter the pump at an interstage location for passage through only subsequent stages of the pump for evacuating a second system, said first and second systems each having a gas outlet flange for attachment to a first or a second pump inlet, in which the vacuum pump is mounted relative to the respective first and second systems such that the longitudinal axis of the shaft is inclined to each of the gas outlet flanges.

2. The vacuum pump as claimed in claim 1, in which the shaft is inclined at an angle between 10 and 80 degrees inclusive.

3. The vacuum pump as claimed in claim 2, in which the shaft is inclined at an angle of 45 degrees.

4. The vacuum pump as claimed in any one of claimed in claim 1 in which the pump stages are sized differently and are spaced one from another a distance equal to between 0.1 and 0.9 times the larger stage diameter.

* * * * *